US005612278A

United States Patent [19]

Masubuchi et al.

[11] Patent Number: 5,612,278

[45] Date of Patent: Mar. 18, 1997

[54] REVERSIBLE IMAGE RECORDING METHOD USING REVERSIBLE THERMOSENSITIVE RECORDING MATERIAL

[75] Inventors: Fumihito Masubuchi; Yoshihiko Hotta, both of Mishima; Yusuke Takeda, Yokohama; Makoto Obu, Yokohama; Toshio Kawakubo, Yokohama; Katsuaki Miyawaki, Yokohama; Tetsuya Amano, Numazu, all of Japan

[73] Assignee: Ricoh Company, Ltd., Tokyo, Japan

[21] Appl. No.: 280,336

[22] Filed: Jul. 25, 1994

Related U.S. Application Data

[63] Continuation-in-part of Ser. No. 164,778, Dec. 10, 1993, abandoned, which is a continuation of Ser. No. 34,811, Mar. 19, 1993, abandoned.

[30] Foreign Application Priority Data

Mar. 21, 1992 [JP] Japan ..... 4-094754

[51] Int. Cl.[6] ..... B41M 5/34

[52] U.S. Cl. ..... 503/201; 503/217; 503/225

[58] Field of Search ..... 503/200, 201, 503/217, 225

[56] References Cited

U.S. PATENT DOCUMENTS 5,158,926 10/1992 Hotta et al. ..... 503/217

5,278,128 1/1994 Hotta et al. .

5,298,476 3/1994 Hotta et al. .

*Primary Examiner*—Pamela R. Schwartz

*Attorney, Agent, or Firm*—Oblon, Spivak, McClelland, Maier & Neustadt, P.C.

[57] ABSTRACT

A recording method of forming images on a reversible thermosensitive recording material, by bringing a heating element of a thermal head into pressure contact with the reversible thermosensitive recording material, which is capable of assuming a first colored state when heated to a first temperature which is higher than room temperature, and then cooled, and which is capable of assuming a second colored state when heated to a second temperature which is higher than the first temperature, and then cooled, and relatively moving at least one of the heating element or the reversible thermosensitive recording material, wherein the stress exerted on the reversible thermosensitive recording material per unit area thereof, $\sigma(g/cm^2)$, which is generated by the pressure contact of the heating element with the reversible thermosensitive recording material and the relative movements of the heating material and the reversible thermosensitive recording material, is represented by formula (I):

$$\sigma \leqq A(Ts/T)+B \quad \text{(I)},$$

wherein A is $8.0\times10^4$, B is $-5.78\times10^4$, T (K°) represents the temperature of the surface of the heating element and Ts (K°) represents the softening point of the reversible thermosensitive recording material.

6 Claims, 9 Drawing Sheets

REVERSIBLE IMAGE RECORDING METHOD USING REVERSIBLE THERMOSENSITIVE RECORDING MATERIAL

This application is a continuation-in-part of application Ser. No. 08/164,778, filed Dec. 10, 1993, now abandoned, which is a continuation of application Ser. No. 08/034,811, filed Mar. 19, 1993, now abandoned.

BACKGROUND OF THE INVENTION

1. Field of the Invention

The present invention relates to a reversible image recording method using a reversible thermosensitive material which is capable of recording and erasing information repeatedly by the application of heat thereto, and more particularly to n reversible image recording method using a film or card which comprises the above-mentioned reversible thermosensitive recording material.

2. Discussion of Background

Recently a rewritable thermosensitive recording material has been demanded for saving paper resources. As most promising rewritable thermosensitive recording materials as such recording materials, Japanese Laid-Open Patent Applications 54-119377 and 55-154198 have disclosed reversible thermosensitive recording materials, each of which comprises a support and a reversible thermosensitive recording layer formed thereon, comprising a matrix resin such as polyester, and an organic low-molecular-weight material such as a higher alcohol or higher fatty acid, which is dispersed in the matrix resin.

In the reversible thermosensitive recording materials of the above-mentioned type, recording and erasure of information, that is, the formation and erasure of images, are achieved by utilizing the temperature-dependent transparency-changing properties of the reversible thermosensitive recording layer in the recording material. In the same manner as in the conventional thermosensitive recording materials of an irreversible type, images can be formed on the reversible thermosensitive recording material by use of a heating element such as a thermal head or a hot stamp, and moreover, images thus formed on the recording material can be reversibly erased therefrom with the application of heat thereto.

A thermal head is in most general use to apply heat to the irreversible thermosensitive recording material for recording, and repeated image formation and erasure by use of a thermal head on the reversible thermosensitive recording material has also been studied.

However, it has been recently found that repeated image formation and erasure on the reversible thermosensitive recording material by use of a thermal head remarkably accelerates the deterioration of the reversible thermosensitive recording material in comparison with other heat application means, for instance, a hot stamp.

Moreover, the inventors of the present invention have discovered that the deterioration of the reversible thermosensitive recording material is mainly caused by the stress which is generated in the reversible thermosensitive recording material during the relative movements of a heating element of a thermal head and the reversible thermosensitive recording material when images are recorded and/or erased.

SUMMARY OF THE INVENTION

It is therefore an object of the present invention to provide a reversible image recording method by which a reversible thermosensitive recording material is not caused to deteriorate even when image formation and/or image erasure are repeated by use of a thermal head.

The above object of the present invention is achieved by a reversible image recording method of forming images on a reversible thermosensitive recording material, by bringing a heating element of a thermal head into pressure contact with the reversible thermosensitive recording material, which is capable of assuming a first colored state when heated to a first temperature which is higher than room temperature, and then cooled, and which is capable of assuming a second colored state when heated to a second temperature which is higher then the first temperature, and then cooled, and relatively moving at least one of the heating element and the reversible thermosensitive recording material, wherein the stress exerted on the reversible thermosensitive recording material per unit area thereof, $\sigma$ (g/cm$^2$), which is generated by the pressure contact of the heating element with the reversible thermosensitive recording material and the relative movements of the heating material and the reversible thermosensitive recording material, is represented by formula (I):

$$\sigma \leqq A(Ts/T)+B \qquad \text{(I)},$$

wherein A is $8.0\times10^4$, B is $-5.78\times10^4$, T (K°) represents the temperature of the surface of the heating element and Ts (K°) represents the softening point of the reversible thermosensitive recording material. In the above formula (I), it is preferable that the values of A and B be respectively $7.0\times10^4$, and $-5.10\times10^4$, more preferably respectively $7.0\times10^4$, and $-5.30\times10^4$, and that the value of $\sigma$ be in the range of $1\times10^2$ to $1\times10^5$ (g/cm$^2$) for use in practice.

It is preferable that the reversible thermosensitive recording material for use in the above method comprise a support and a reversible thermosensitive recording layer formed thereon, comprising a matrix resin and an organic low-molecular-weight material dispersed in the matrix resin, capable of reversibly assuming a transparent state and a milky white opaque state with the application of heat to the reversible thermosensitive recording material depending on the temperature thereof.

Further it is preferable that the relative movements of the reversible thermosensitive recording material and the heating element be composed of the repetition of minute relative movements and terminations thereof, and the period in which the reversible thermosensitive recording material is softened in contact with the heating element and the period of the minute termination overlap.

Moreover it is preferable that the stress exerted to the reversible thermosensitive recording material by the heating element while the reversible thermosensitive recording material is softened in contact with the heating element be set smaller than the stress exerted thereto by the heating element before and after the softening of the reversible thermosensitive recording material.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The mechanism of the deterioration of a reversible thermosensitive recording material by the frictional stress exerted when image formation and image erasure are conducted by use of heating means such as a thermal head has not yet been completely clarified. However, the mechanism is considered to be as follows:

A conventional reversible thermosensitive recording material comprises a support and a recording layer formed thereon, comprising as the main components an organic low-molecular-weight material and a matrix resin in which the organic low-molecular-weight material is dispersed. The moment the reversible thermosensitive recording material is heated for recording by use of a thermal head, the recording layer of the reversible thermosensitive recording material becomes very soft because the organic low-molecular-weight material and the matrix resin are heated to a temperature above the melting point of the organic low-molecular-weight material and/or the softening point of the matrix resin.

As a result, the reversible thermosensitive recording material can be easily deformed by a slight frictional stress exerted between the recording material and the thermal head, so that the structure of the reversible thermosensitive recording material is changed. The accumulation of such changes in the structure of the reversible thermosensitive recording material is considered to cause the deterioration thereof.

The deformation which is generated within the reversible thermosensitive recording material during image recording and/or image erasure can be approximately determined by the stress which is applied to the recording material, and also by the viscoelasticity of the recording layer thereof at the moment of the application of the stress.

Rheology deals with the relationship between the stress applied to a viscoelastic material and the deformation thereof.

Figure 1:
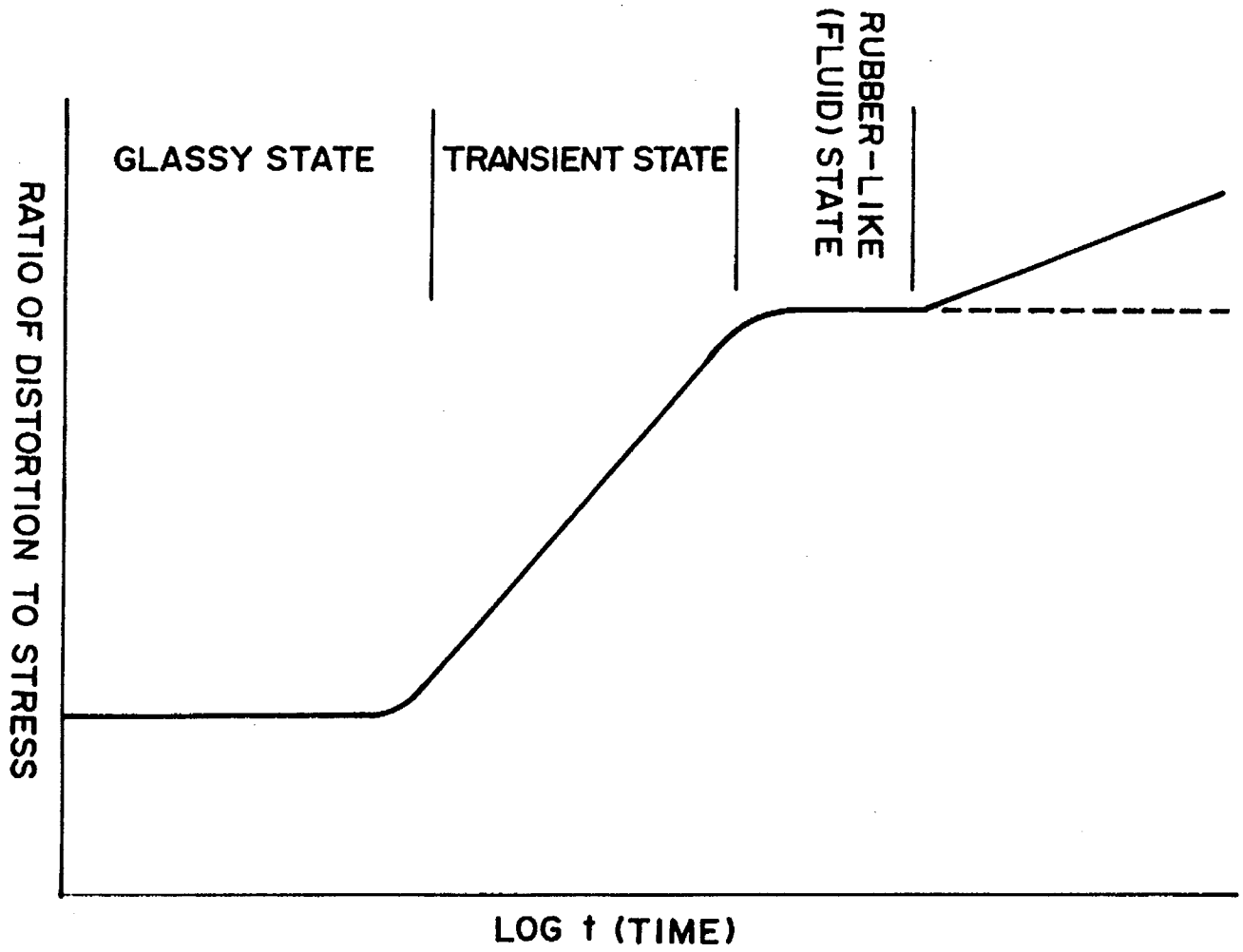
FIG. 1 is a diagram showing the changes in the distortion of a general viscoelastic material with time when a predetermined stress is applied thereto.
Figure 2:
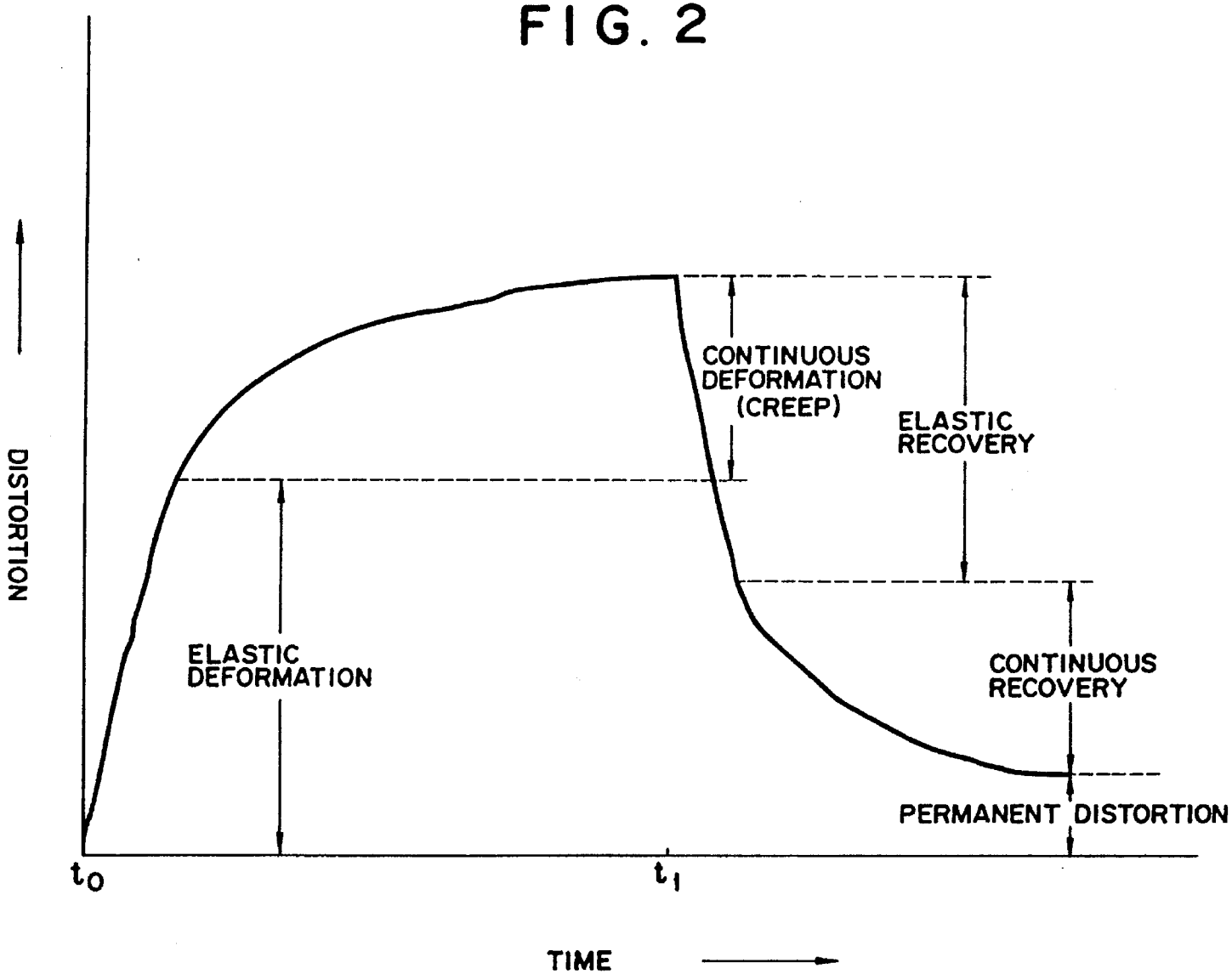
FIG. 2 is a diagram showing a general qualitative relationship between the distortion of a polymeric material or resin when a predetermined stress is applied thereto and the time period of the application of the stress.

A general qualitative relationship between the distortion of a viscoelastic material under the application of a predetermined stress thereto and the time of the application of the stress is shown in FIG. 1 and FIG. 2.

FIG. 1 shows the changes in the distortion of a general viscoelastic material when a predetermined stress is applied thereto, in particular, the changes in the state of a general viscoelastic material with time when a predetermined stress is applied thereto. In the graph shown in FIG. 1, the abscissa indicates the time of the application of the stress, and the ordinate indicates the ratio of the distortion to the stress.

The viscoelaetic material is in a hard glassy state immediately after the application of the stress, and thereafter the state is gradually changed to a rubber-like state. In the case where the viscoelastic material is an amorphous polymer, and is in the above-mentioned rubber-like state, the amorphous polymer exhibits a fluidity as shown by the solid line in the graph in FIG. 1. By contrast, in the case where the viscoelastic material is a crystalline polymer or cross-linked polymer, and is in the above-mentioned rubber-like state, the crystalline or cross-linked polymer does not exhibit a fluidity as indicated by the broken line in the graph in FIG. 1.

In the case of a resin which exhibits a fluidity, the deformation thereof is as shown in FIG. 2. More specifically, FIG. 2 shows a general qualitative relationship between the distortion of the resin when a predetermined stress is applied thereto and the time period of the application of the stress. In FIG. 2, the abscissa indicates the time and the ordinate indicates the distortion of the resin.

When the application of a predetermined stress to a viscoelastic resin is initiated at time $t_0$, an elastic deformation is instantaneously caused in the resin, and successively, a continuous deformation which is called creep is caused. The creep is composed of a component of elastic deformation and a component of viscous flow. When the applied stress is eliminated at time $t_1$, elastic recovery instantaneously takes place in the resin, and successively, continuous recovery with a time lag begins. However, the distortion of the resin is not completely removed even after the elimination of the stress, so that a permanent distortion remains in the resin.

Such permanent distortion accumulates in the reversible thermosensitive recording material while image formation and image erasure are repeated, so that the internal structure of the recording material is deformed.

In particular, in the case of a reversible thermosensitive recording material which comprises a recording layer comprising a matrix resin and an organic low-molecular-weight material which is dispersed in the matrix resin, the dispersion structure of the recording layer is changed by the deformation of the recording material, to be more specific, the particles of the organic low-molecular-weight material dispersed in the matrix resin are deformed, and/or the particle diameter thereof is changed. Consequently, the temperature range in which images can be formed on the reversible thermosensitive recording material and the image density obtained are also changed.

The above changes of the reversible thermosensitive recording material are considered as the deterioration thereof by the users, so that there is a demand for a reversible image recording method which minimizes the changes in the dispersion structure of the recording layer of the reversible thermosensitive recording material.

The previously mentioned problem is common between a reversible thermosensitive recording material in which the reversible recording function is provided by use of two or more kinds of materials in combination, and a reversible thermosensitive recording material to which a binder agent is added to impart self-supporting properties to the recording material.

It is preferable that no permanent distortion take place in the reversible thermosensitive recording material when images are recorded by use of a thermal head. For this purpose, it is required that the stress applied to the recording material be 0, that is, the contact pressure applied thereto be 0, during image recording.

On the other hand, it is required that some contact pressure be applied to the reversible thermosensitive recording material when recording images by use of a thermal head in order to make the heat transfer to the recording material uniform.

Therefore, in practice, there is adopted a reversibly image recording method in which the contact pressure applied to the reversible thermosensitive recording medium by a thermal head is minimized under the conditions that uniform heat transfer can be attained by the thermal head.

In the above, the upper limit of the stress applied to the reversible thermosensitive recording material changes depending on the number of the repetitions of the required image formation and image erasure. It is required that a commercial reversible thermosensitive recording material be capable of repeating image formation and image erasure 100 times or more, so that the upper limit of the stress applied to a reversible thermosensitive recording material for use in practice corresponds to the upper limit of the stress that is applied when image formation and image erasure are repeated several hundreds times.

In the present invention, the stress $\sigma$ and the strength of a reversible thermosensitive recording material are defined by an equation that can be easily derived from the measurement thereof, and the upper limit of the stress $\sigma$ that can be applied during several hundreds repetitions of image formation and image erasure is determined.

More specifically, the inventors of the present invention have discovered from the results of experiments shown in Examples which will be mentioned later that the stress applied to a unit area of the recording material, $\sigma$ (g/cm$^2$), is within the range defined by the following formula (I), in order to obtain the durability of the reversible thermosensitive recording material which is capable of repeating image formation and image erasure in the range of from several hundreds times to about 1,000 times in practical use:

$$\sigma \leqq A(Ts/T)+B \quad \text{(I)}$$

wherein $A=8.0\times10^4$, $B=-5.78\times10^4$, (K°) represents the temperature of the surface of a heating element by which the stress is applied thereto and Ts (K°) represents the softening point of the reversible thermosensitive recording material.

In the above, the stress inside the reversible thermosensitive recording material should be caused to directly correspond to the deformation thereof. However, it is difficult to directly measure the stress exerted inside the reversible thermosensitive recording material, so that a maximum value of the stress exerted to a unit area of the contact surface between the recording material and the thermal head is calculated, whereby the relationship between the thus calculated maximum stress applied to the recording material and the deterioration thereof is derived from the results of the experiments mentioned later.

As will be explained later with reference to Examples, there is a remarkable difference in the degree of the deterioration of the reversible thermosensitive recording material between the stress greater than the value of the stress c defined by the above equation and the stress smaller than the value of the stress $\sigma$ defined by the above-mentioned fomula (I).

In the above fomula (I), it is preferable that the values of A and B be respectively $7.0\times10^4$, and $-5.10\times10^4$, more preferably respectively $7.0\times10^4$, and $-5.30\times10^4$.

The cause for such a difference has not yet been clarified, but it is considered as follows:

A reversible thermosensitive recording material which is deformed by the stress applied thereto by use of the heating element can return to its original shape to some extent by the elastic properties of the recording layer of the recording material when the recording layer is heated and softened. The remarkable difference in the degree of the deterioration of the reversible thermosensitive recording material is considered to be caused by the extent of the recovery of the reversible thermosensitive recording material from its deformation during the softening of the recording layer thereof.

In the Examples described later, with respect to the softening point of the reversible thermosensitive recording material, the presence of a recording layer is ignored, and the softening point of the recording layer is regarded as that of the reversible thermosensitive recording material. This is because the recording layer is originally composed of materials which are easily softened when heated, and has been improved year by year so as to minimize the deterioration thereof. As a matter of fact, the improvement of the recording layer has made a great contribution to the improvement of the recording medium with respect to the deterioration thereof. The presence or absence of the protective layer makes a great difference in the deterioration of the recording medium. However, as the materials for the protective layer, best materials that are conceivable with respect to the overall properties including heat resistance and flexibility have been employed from the beginning of the development of the recording material, and at present there is no longer much difference between the materials for the protective layer with respect to the improvement of the recording medium with respect to the deterioration thereof. Furthermore, the difference in the thickness of the protective layer makes far less contribution to the improvement of the recording medium with respect to the deterioration in comparison with the difference in the quality of the materials for the recording layer.

For these reasons, the softening point of the recording layer is regarded as the softening point of the reversible thermosensitive recording medium, with the presence of the protective layer being ignored.

The softening point of the reversible thermosensitive recording material for use in the present invention is defined as follows:

The theological characteristics of the recording layer of the reversible thermosensitive recording material are investigated in accordance with the penetration test method. The penetration into the recording layer, which depends on the temperature of the recording layer, is measured by use of a penetration test apparatus in accordance with the Japanese Industrial Standards JIS-K2808. The details of the measurement of the penetration will be described later in Examples.

Figure 3:
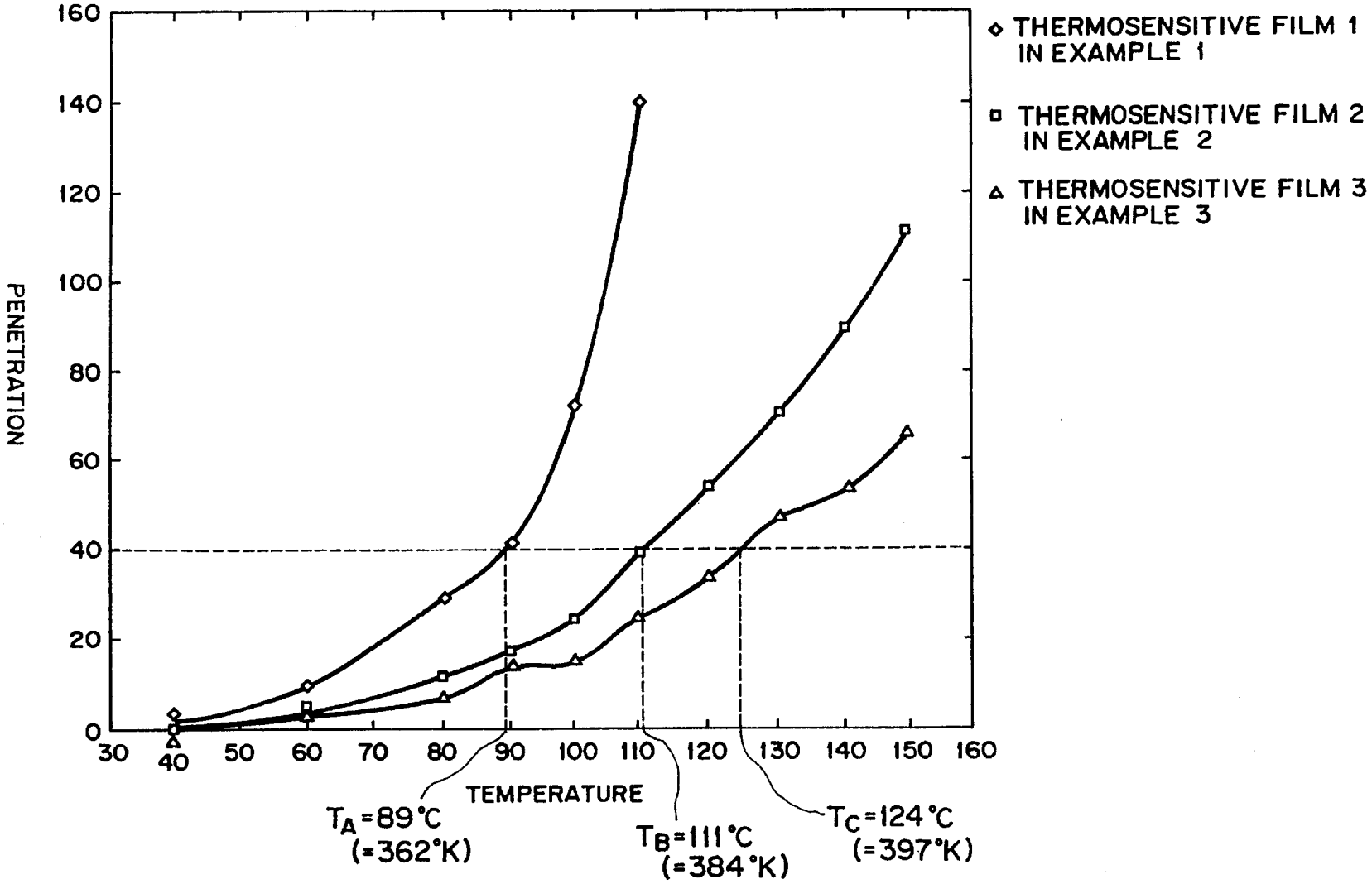
FIG. 3 is a graph showing the results of penetration tests of reversible thermosensitive recording materials which indicate the theological characteristics thereof.

Examples of the results of the penetration test are shown in FIG. 3. The temperature at which the penetration reaches 40 as shown in FIG. 3 is defined as the softening point of the reversible thermosensitive recording material. The softening points of Thermosensitive Film 1, Thermosensitive Film 2 and Thermosensitive Film 3 are respectively $T_A$, $T_B$ and $T_C$ in FIG. 3, which will be explained in detail later.

Figure 4:
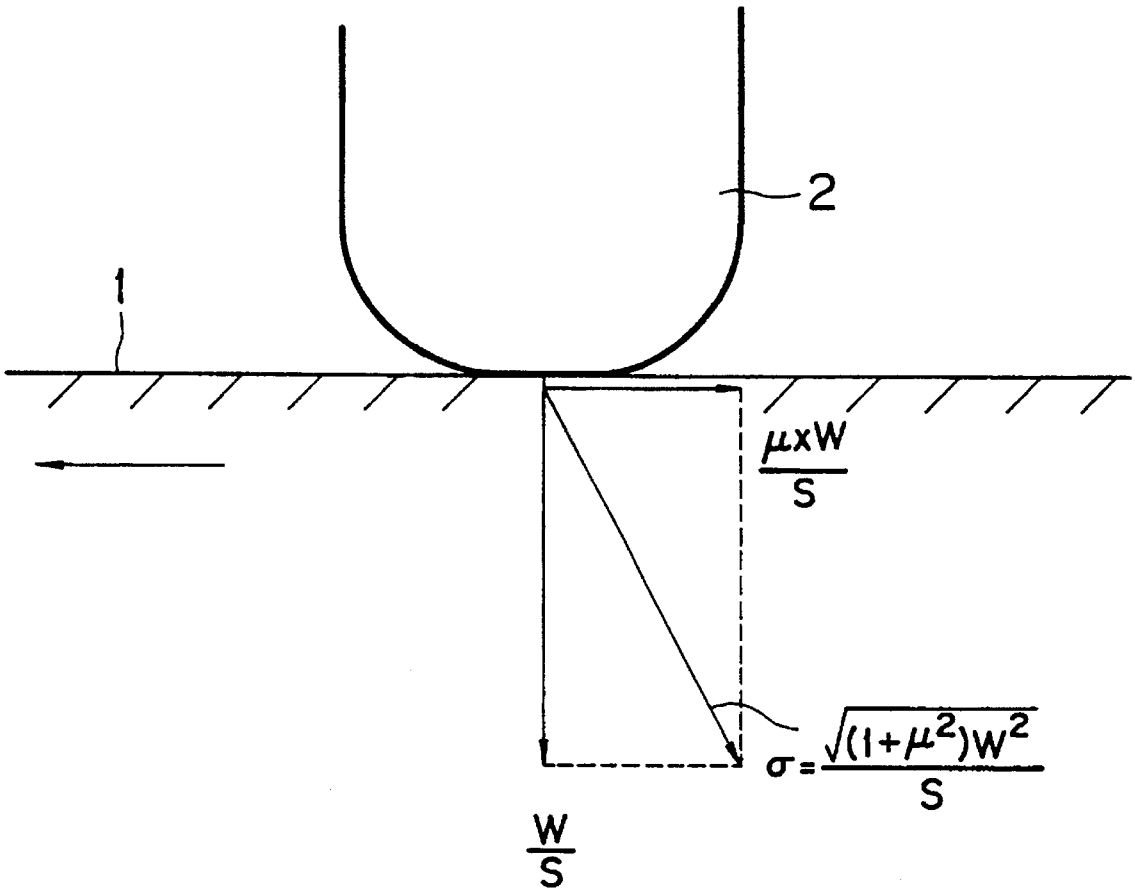
FIG. 4 is a schematic diagram of an apparatus for measuring the shear stress between a reversible thermosensitive recording material and a heating element.

Moreover, the stress applied to a unit area of reversible thermosensitive recording material, $\sigma$ (g/cm$^2$), is defined as follows:

AS illustrated in FIG. 4, the shearing stress which is generated by the contact of a heating element 2 with a reversible thermosensitive recording material 1 and/or by the relative movement of the heating material 2 to the reversible thermosensitive recording material 1 is considered to be a resultant force of (i) a stationary contact loading W exerted perpendicularly to a recording surface of the reversible thermosensitive recording material 1, and (ii) a frictional force $\mu$ exerted in a parallel direction to the recording surface. The stress $\sigma$ is defined as the value obtained by dividing the resultant force of (a) the contact loading W while the recording material 1 is stationary relative to the heating element 2 and (b) the frictional force $\mu \times W$ which is generated by moving the recording material 1 relative to the heating element 2 by the contact area S between the reversible thermosensitive recording material 1 and the heating element 2. The contact loading W, the frictional force $\mu$ and the contact area S are obtained by the actual measurement thereof. The stress per unit area of the reversible thermosensitive recording material is represented by the following equation (II):

$$\sigma = \frac{\sqrt{(1+\mu^2)W^2}}{S} \qquad \text{(II)}$$

The reversible thermosensitive recording material is caused to deteriorate not only by the deformation of the recording material by the stress applied thereto, but also by the compatibility of the matrix resin and the organic low-molecular-weight material in the reversible thermosensitive recording material. When a coating liquid comprising the matrix resin and the organic low-molecular-weight material is dried to form a recording layer of the reversible thermosensitive recording material, the matrix resin and the organic low-molecular-weight material are not mutually dissolved in a temperature range of approximately 70° C. to 120° C., which differs depending on the materials to be employed, and the organic low-molecular-weight material is dispersed in the matrix resin. Therefore, the above matrix resin and organic low-molecular-weight material constitute a dispersed structure. As a matter of course, depending upon the temperature, there is a region in which the matrix resin and the organic low-molecular-weight material exhibit compatibility.

In the case where the temperature range in which the matrix resin and the organic low-molecular-weight material exhibit compatibility is on a temperature side which is higher than the temperature for the drying process for the coating liquid for the formation of the recording layer, the organic low-molecular-weight material is melted and the matrix resin is softened, so that the moment the temperature of the recording layer reaches the above-temperature range by the application of heat thereto by a thermal head, the organic low-weight material and the matrix resin begins to exhibit compatibility, and the compatible state is maintained even after the recording layer is cooled, so that the recording layer is caused to deteriorate. The deterioration caused by this compatibility is promoted by the deformation of the recording layer caused by the stress applied thereto.

This compatible phenomenon of the matrix resin and the organic low-molecular-weight material more conspicuously takes place in the recording layer of the reversible thermosensitive recording material as the amount of thermal energy applied thereto is increased. Furthermore, when a predetermined image density is obtained by the pulse-like application of thermal energy to the recording layer of the reversible thermosensitive recording material, the narrower the pulse width, the more conspicuously the compatible phenomenon takes place.

Figure 5A:
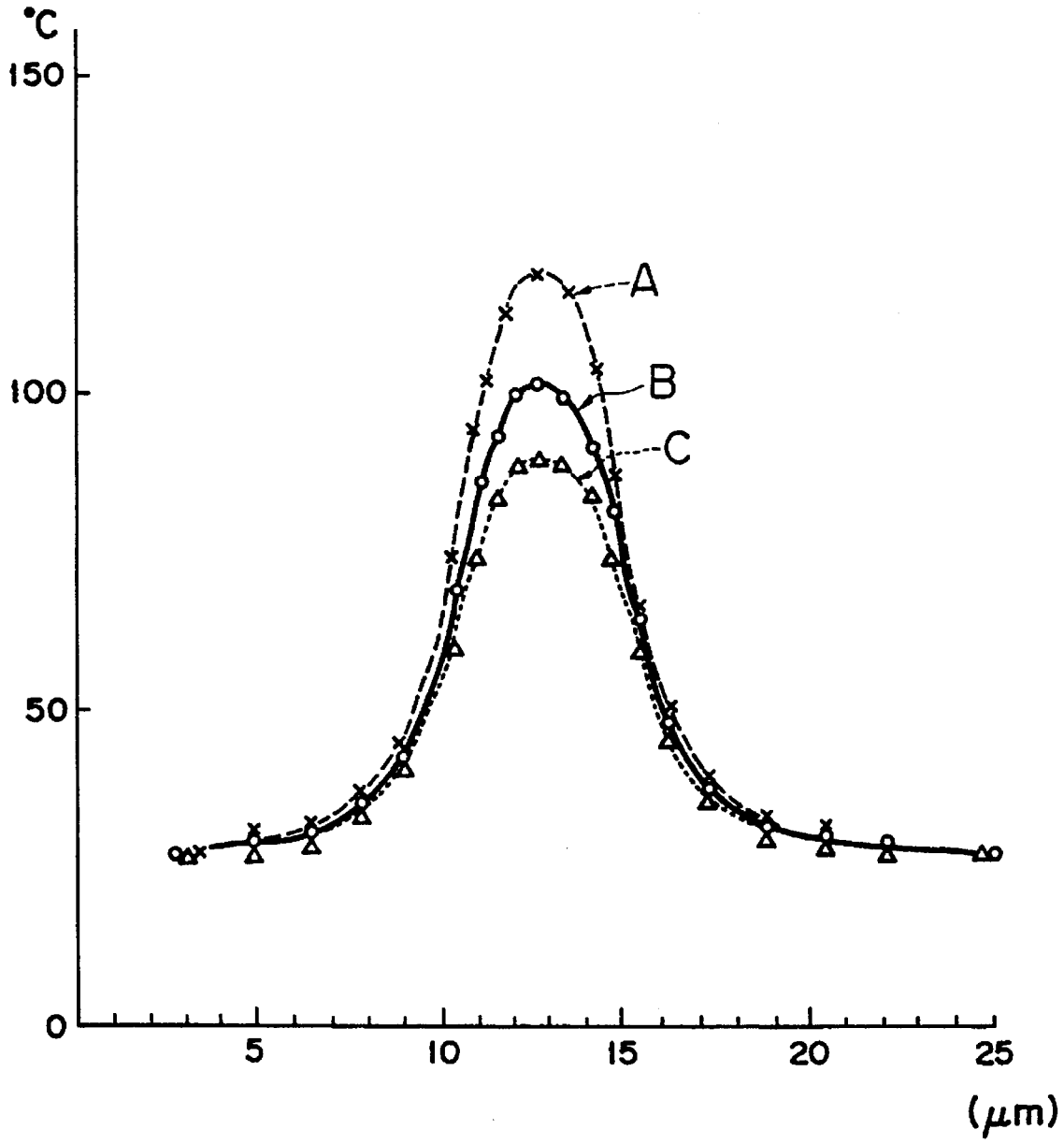
FIGS. 5(*a*) and 5(*b*) are graphs showing the differences in the temperature gradients of a recording layer of a reversible thermosensitive recording material for use in the present invention when the width of a thermal energy application pulse is changed.
Figure 5B:
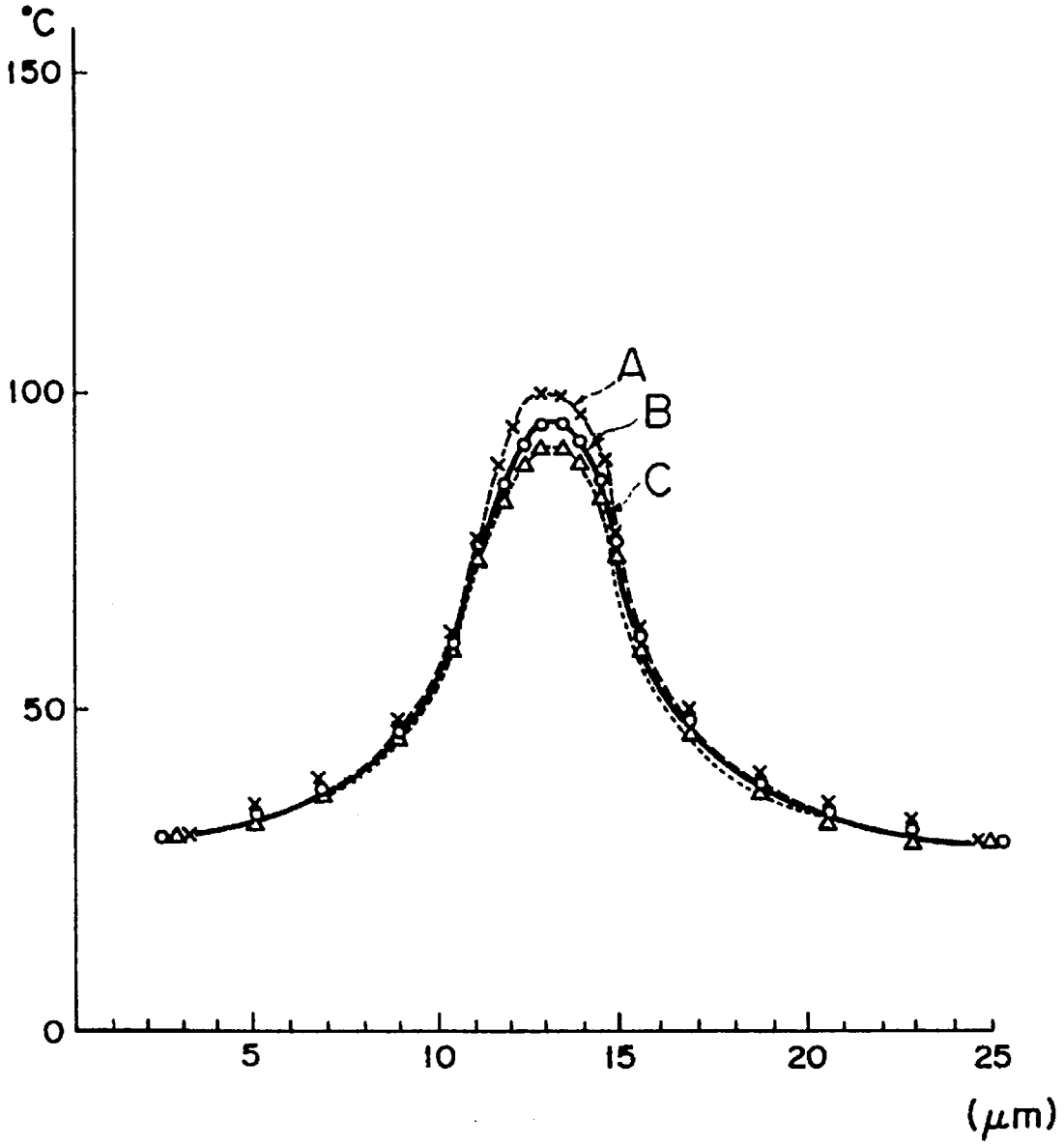

When thermal energy is applied to the recording layer of the reversible thermosensitive recording material by using a thermal head, with the pulse width for the application of thermal energy changed, the narrower the pulse width, the higher the temperature gradations in the various parts of the reversible thermosensitive recording medium as shown in FIGS. 5(*a*) and 5(*b*).

More specifically, in FIG. 5(*a*), the temperature gradients in an upper portion (A), an intermediate portion (B) and a lower portion (C) of a reversible thermosensitive recording material are plotted, when thermal energy was applied with a pulse width of 2 msec ($t_p$=2 msec) with the temperature of the recording layer as ordinate and the position in the recording layer in the direction of the width thereof as abscissa. The temperature gradient curve for the upper portion (A) is indicated by a curve with marks —X—X—; the temperature gradient curve for the intermediate portion (B) is indicated by a curve with marks —O—O—and the temperature gradient curve for the lower portion (C) indicates by a curve with marks —Δ—Δ—.

FIG. 5(*b*) also shows the temperature gradients in the upper portion (A), the intermediate portion (B) and the lower portion (C) of the same reversible thermosensitive recording material as in FIG. 5(*b*) are plotted, when thermal energy was applied with a pulse width of 9 msec ($t_p$=9 msec) with the temperature of the recording layer as ordinate and the portion in the recording layer in the direction of the width thereof as abscissa.

The narrower the pulse width, the higher the temperature gradient with respect to time, so that when obtaining a predetermined image density the narrower the pulse width for the application of thermal energy, the higher the peak position of the temperature gradient curve in each of the above-mentioned portions (A), (B) and (C), and accordingly the quicker the cooling of the recording layer. Thus, in the above case, the compatible state tends to be fixed, so that the deterioration of the recording material proceeds rapidly.

Therefore, in order to prevent the deterioration of the reversible thermosensitive recording material caused by the compatibility of the matrix resin and the organic low-molecular-weight material in the recording layer, it is preferable to apply thermal energy application with a wide energy pulse width to the recording material, or to apply thermal energy with a plurality of energy pulses to the same portion thereof.

As mentioned above, to prevent the shearing stress from unrecoverably deforming the organic low-molecular-weight material dispersed in the matrix resin, it is preferable that a crystalline polymer be employed as the matrix resin for the reversible thermosensitive recording material, and a thermal head for the application of a small amount of thermal energy, for instance, by the application of thermal energy by a thermal pulse with a large pulse width of 1 msec or more, more preferably by a thermal pulse with a pulse width of 2 msec or more, furthermore preferably by a thermal pulse with a pulse width of 5 msec or more. As mentioned above, a plurality of energy pulse applications can be also be used.

The particularly effective means for preventing the unrecoverable deformation of the particles of the organic low-molecular-weight material is to minimize the pressure applied to the recording material through the thermal head. More specifically, it is preferable that the pressure applied to the thermal head be 10 kg/cm$^2$ or less, more preferably 1 kg/cm$^2$ or less, most preferably 100 g/cm$^2$ or less when images are formed, as can be seen from the results of the Examples described later.

As specific means for reducing the shearing stress, the reduction of the stationary load W between the heating element and the reversible thermosensitive recording material, and the reduction of the coefficient of friction ($\mu$) between the heating element and the reversible thermosensitive recording material may be considered.

In addition, the following method can be proposed, in which the relative movements of the thermal head and the reversible thermosensitive recording material are performed by intermittent drive by use of a pulse motor, and the timing of the intermittent drive and the thermal printing pulse of the thermal head is adjusted in such a manner that the reversible thermosensitive recording material and the thermal head are not relatively moved when the reversible thermosensitive recording material is softened by the application of heat application pulses to the thermal head, and the reversible thermosensitive recording material and the thermal head are relatively moved when the reversible thermosensitive recording material is most cooled after the completion of the application of the heat application pulses thereto.

Figure 8:
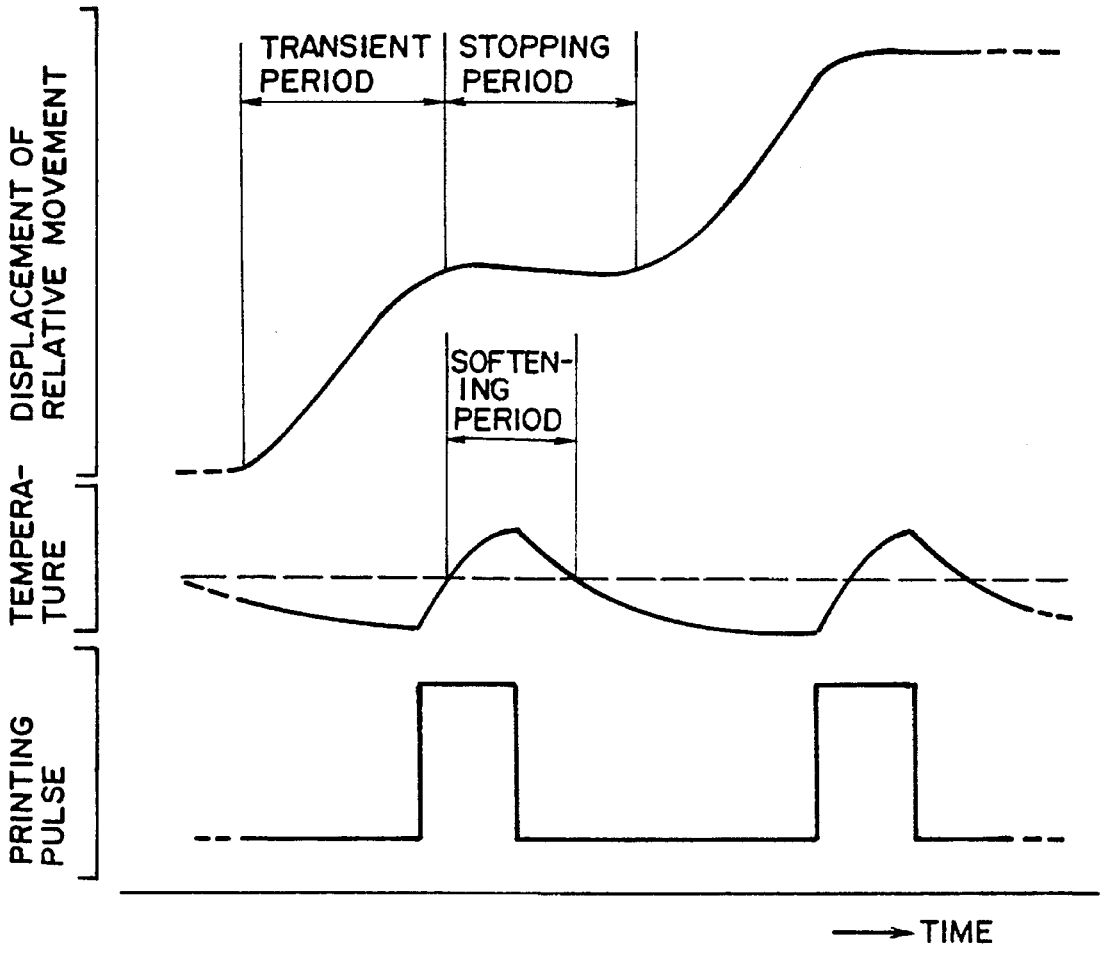
FIG. 8 is a diagram showing the relative movements of a thermal head and a reversible thermosensitive recording material which are performed by intermittent drive by use of a pulse motor, and the timing of the intermittent drive and the thermal printing pulse of the thermal head in an example of a reversible image recording method of the present invention.

Specifically, it is preferable that the abovementioned timing be as shown in FIG. 8, in which at least the termination point of the application of the printing pulse, that is, the point at which the temperature becomes maximum, be within the stopping period, more preferably within the first half of the stopping period. According to this method, the shearing stress can be reduced by the amount corresponding to the application of no frictional force to the recording layer while it is softened.

Figure 9A:
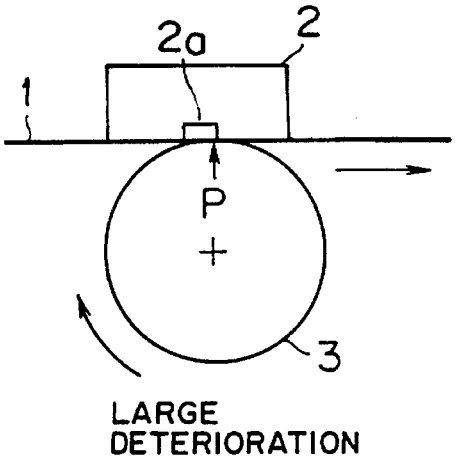
FIGS. 9(*a*) and 9(*b*) show the configurational relationship between the peak position of the stationary load of a platen roller which faces a thermal head with respect to the center of the heating element of the thermal head and the deterioration of the reversible thermosensitive recording material caused by the heating element.
Figure 9B:
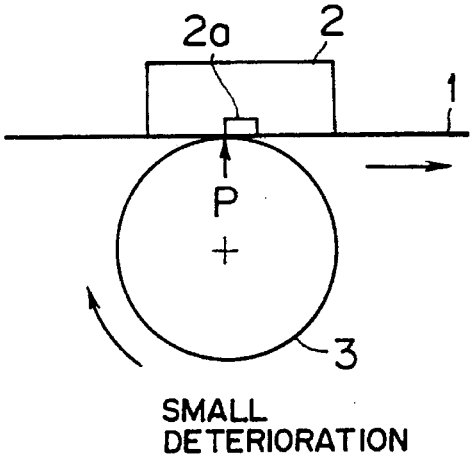

Furthermore as shown in FIG. 9(*b*), by positioning the peak position of the stationary load of a platen roller 3, which faces a thermal head 2, upstream of the center of a heating element 2*a*, the contact pressure of the heating element 2*a* against the reversible thermosensitive recording material 1 can be set high until immediately before the reversible thermosensitive recording material is softened in contact with the heating element 2*a*, and the contact pressure of the heating element 2*a* against the reversible thermosensitive recording material 1 can be reduced after the reversible thermosensitive recording material is softened, whereby the shearing stress can effectively reduced and therefore the deterioration of the recording material is small.

By contrast, in FIG. 9(*a*), the peak position of the stationary load of the platen roller 3 is placed downstream of the center of the heating element 2*a*, so that the deterioration of the recording material is large.

The reversible thermosensitive recording material for use in the present invention has specific color which does not change at room temperature and can assume a first colored state when heated to a first temperature and can assume a second colored state when heated to a second temperature which is higher than the first temperature and then cooled to room temperature.

The reversible thermosensitive recording material for use in the present invention is capable of reversibly changing the colored stated as mentioned above. The changes in the colored state include changes in the transmittance, reflectance, absorbed wavelength and the light scattering degree of the material. A reversible thermosensitlve recording material for use in practice utilizes the combination of the above changes when used as a display means. More specifically, such reversible thermosensitive recording materials are roughly classified into the following groups (A) a material capable of reversibly assuming a transparent state and a white opaque state.

(B) a material with a dye which is capable of reversibly changing the color thereof.

Japanese Laid-Open Patent Applications 2-18829 and 2-188294 disclose representative examples of materials of the above type (A).

The matrix resin for use in the reversible thermosensitive recording layer, which imparts high transparency, high mechanical stability and excellent film-forming properties to the thermosensitive recording layer are preferably employed.

Examples of such a matrix resin are polyvinyl chloride; vinyl chloride copolymers such as vinyl chloride—vinyl acetate copolymer, vinyl chloride—vinyl acetate—vinyl alcohol copolymer, vinyl chloride—vinyl acetate—maleic acid copolymer, and vinyl chloride—acrylate copolymer; polyvinylidene chloride; vinylidene chloride copolymers such as vinylidene chloride—vinyl chloride copolymer, and vinylidene chloride—acrylonitrile copolymer; polyester; polyamide; polyacrylate; polymethacrylate; acrylate—methacrylate copolymer; and silicone resin. These resins can be used alone or in combination.

The organic low-molecular-weight material for use in the reversible thermosensitive recording layer may be selected from the materials which are changeable from a polycrystalline state to a single crystalline state by heating. It is preferable that the organic low-molecular-weight material for use in the present invention have a melting point ranging from 30° C. to 200° C., more preferably from about 50° C. to 150° C.

Examples of such an organic low-molecular-weight material for use in the present invention are alkanols) alkane diols; halogenated alkanols or halogenated alkane diols) alkylamines; alkanes; alkenes; alkynes; halogenated alkanes; halogenated alkenes; halogenated alkynes; cycloalkanes; cycloalkenes; cycloalkanes; saturated or unsaturated mono- or di-carboxylic acids, and esters, amides and ammonium salts thereof; saturated or unsaturated halogenated fatty acids, and esters, amides and ammonium salts thereof; alkylcarboxylic acids, and esters, amides and ammonium salts thereof; halogenated alkylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination. Of the above compounds, higher fatty acids having 16 or more carbon atoms such as palmitic acid, stearic acid, behenic acid and lignoceric acid are more preferably employed for use in the present invention.

The solvent used for the formation of the thermosensitive recording layer or thermosensitive recording material can be selected in accordance with the kind of the matrix resin and the type of the organic low-molecular-weight material to be employed.

Examples of the solvent for use in the present invention are tetrahydrofuran, methyl ethyl ketone, methyl isobutyl ketone, chloroform, carbon tetrachloride, ethanol, toluene and benzene. Not only when a dispersant is used as a solvent, but also when a solution is used, the organic low-molecular-weight material is present in the form of separated finely-divided particles in a state of dispersion in the matrix resin of the thermosensitive recording layer.

Figure 6:
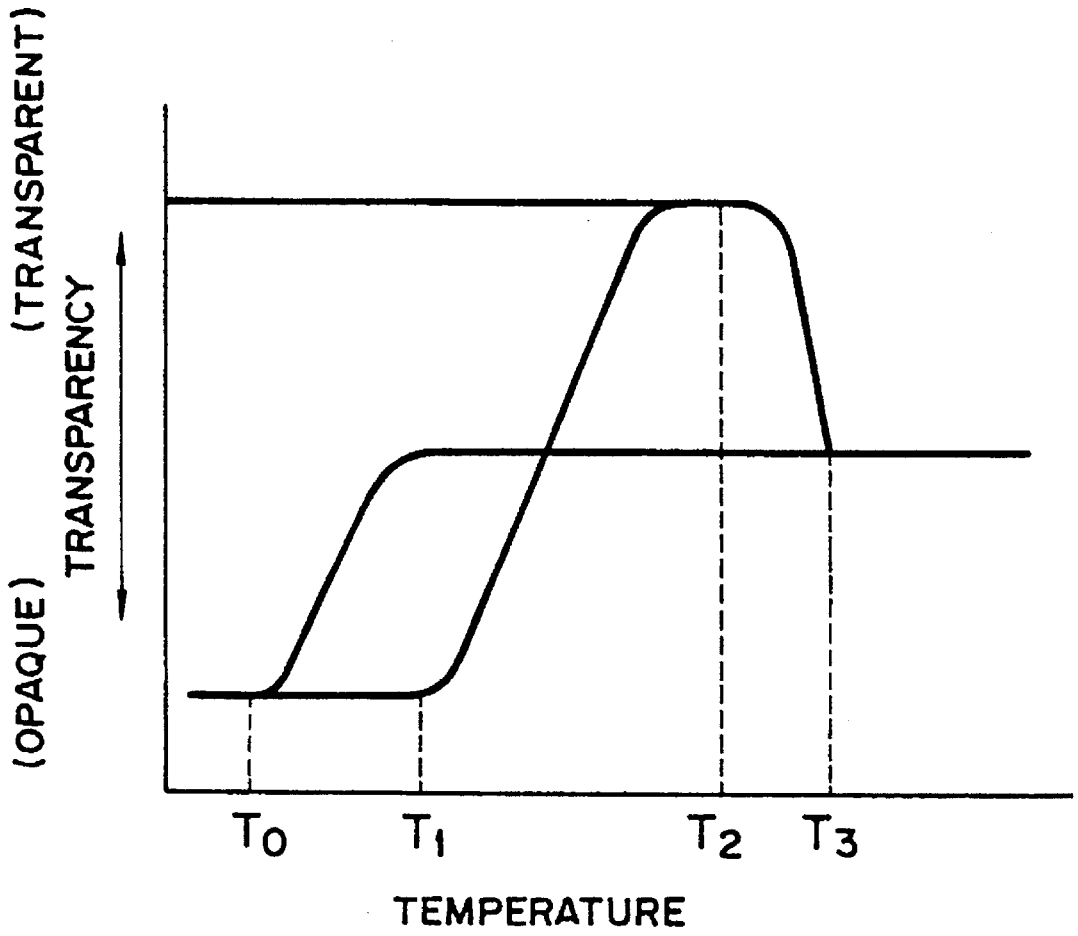
FIG. 6 is a diagram in explanation of the principle of formation and erasure of images in a reversible thermosensitive recording material for use in the present invention.

The reversible thermosensitive recording material comprising a matrix resin and an organic low-molecular-weight material which is dispersed therein can be switched from a transparent state to a milky white opaque state, and vice versa, depending on the temperature thereof. The difference between the transparent state and the milky white opaque state of the recording material is considered to be based on the following principles:

As shown in FIG. 6, in the transparent state, the organic low-molecular-weight material dispersed in the matrix resin is composed of relatively large crystals, so that the light which enters the crystals from one side passes therethrough to the opposite side, without being scattered, so that the reversible thermosensitive recording material appears transparent.

By contrast, in the milky white opaque state, the organic low-molecular-weight material is composed of polycrystals consisting of numerous small crystals, with the crystallographic axes pointed to various directions, so that the light which enters the recording material is scattered a number of times at the interfaces of the crystals of the low-molecular-weight material. As a result, the reversible thermosensitive recording material appears opaque in a milky white color.

The transition of the state of the reversible thermosensitive recording material depending on the temperature thereof will now be explained by referring to FIG. 6.

In FIG. 6, it is supposed that the reversible thermosensitive recording material comprising a matrix resin and a low-molecular-weight material dispersed in the matrix resin is initially in a milky white opaque state at room temperature $T_0$ or below. When the recording material is heated to temperature $T_2$, the recording material becomes transparent. Thus, the recording material reaches a maximum transparent state at temperature $T_2$. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to temperature $T_3$ or more, it assumes a medium state which is between the maximum transparent state and the maximum milky white opaque state. When the recording material in the medium state at temperature $T_3$ or more is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording material in the milky white opaque state is heated to any temperature between temperature $T_1$ and temperature $T_2$, and then cooled to the room temperature $T_0$ or below, the recording material assumes an intermediate state between the transparent state and the milky white opaque state.

when the recording material in the transparent state at room temperature $T_0$ is again heated to temperature $T_3$ or above, and then cooled to room temperature $T_0$, the recording material returns to the milky white opaque state. Thus, the reversible thermosensitive recording material for use in the present invention can assume the maxime milky white opaque state, the maximum transparent state and the intermediate state between the aforementioned two states at room temperature.

Japanese Laid-Open Patent Applications 54-119377 and 55-154198 disclose reversible thermosensitive recording materials of the previously mentioned type (B).

Each of the reversible thermosensitive recording materials of the type (B) comprises a matrix resin, for example, polyvinyl alcohol, ethyl cellulose, cellulose acetate, polystyrene, polyvinyl chloride, linear saturated polyester, a methacrylic resin such as polymethyl methacrylate, and polyethyl methacrylate, or a homopolymer or copolymer of the monomer of any of the above polymers, or a thermoplastic resin such as polyurethane, polybutyral, or nitro cellulose; a leuco dye such as Crystal violet lactone, 3-indolino-3-p-dimethylaminophenyl-6-dimethylaminophthalido, 3-diethylamino-7-chlorofluorane, or 2-(2-fluorophenylamino)-6-diethylaminofluorane; and a developer capable of inducing color formation in the leuco dye, such as higher fatty amine salt of bis(hydroxyphenyl)acetate, or a fatty amine salt of gallic acid.

The mechanism of the color changing of such reversible thermosensitive materials from a colorless state to a colored state and then back from the colored state to the colorless state is considered as follows:

A colorless leuco dye is allowed to react with a phenolic compound serving as a color developer capable of inducing a color in the leuco dye by thermal energy applied thereto, and the lactone ring of the colorless leuco dye is opened by the acidic function of the phenolic compound, so that the colorless leuco dye is colored. The opened lactone ring of the colored compound is then closed by the basic group of the phenolic compound serving as the color developer, so that the colored compound is reversibly discolored and becomes colorless.

Other features of this invention will become apparent in the course of the following description of exemplary embodiments which are given for illustration of the invention and are not intended to be limiting thereof.

Example 1 [Preparation of Thermosensitive Film 1]

[Formation Of Reversible Thermosensitive Recording Layer]

The following components were mixed to prepare a coating liquid for forming a reversible thermosensitive recording layer:

| | Parts by Weight |
|---|---|
| Behenic acid | 2 |
| Eicosanedioic acid | 5 |
| Diisodecyl phthalate | 3 |
| Vinyl chloride - vinyl acetate copolymer (Trademark "VYHH", made by Union Carbide Corp.) | 39 |
| Tetrahydrofuran | 152 |
| Toluene | 15 |

The above prepared coating liquid was coated on a polyester film with a thickness of 188 μm, serving as a support and dried, so that a reversible thermosensitive recording layer with a thickness of about 15 μm was formed on the polyester film.

[Formation of Protective Layer]

The following components were mixed to prepare a coating liquid for forming a protective layer:

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Toluene | 10 |

The thus obtained coating liquid was coated on the above formed reversible thermosensitive recording layer, dried, and subjected to ultraviolet irradiation, so that a protective layer comprising an ultraviolet-curing resin with a thickness of about 4 μm was formed on the reversible thermosensitive recording layer.

Thus, a reversible thermosensitive recording material No. 1, which is hereinafter referred to as Thermosensitive Film 1, for use in the present invention was obtained, which is capable of assuming a transparent state when heated to a first specific temperature which ranges from about 70° C. to 100° C., and which is also capable of assuming a milky white state when heated to a second specific temperature which is about 100° C. or more as a second specific temperature.

Furthermore, the previously mentioned coating liquid for the formation of the reversible thermosensitive recording layer was coated on an about 400 Å thick aluminum layer deposited polyester film with a thickness of 188 μm, and dried, so that a reversible thermosensitive recording layer was formed on the aluminum layer deposited polyester film and was then peeled off the polyester film, whereby only a reversible thermosensitive recording layer for Thermosensitive Film 1 was obtained.

Example 2 [Preparation of Thermosensitive Film 2]

[Formation of Reversible Thermosensitive Recording Layer]

The following components were mixed to prepare a coating liquid for forming a reversible thermosensitive recording layer:

| | Parts by Weight |
|---|---|
| Behenic acid | 5 |
| Eicosanedioic acid | 5 |
| Diisodecyl phthalate | 3 |
| Vinyl chloride - vinyl acetate copolymer (Trademark "Denka vinyl #1000MT" made by Denki Kagaku Kogyo K.K.) | 39 |
| Tetrahydrofuran | 261 |
| Toluene | 87 |

The above prepared coating liquid was coated on a polyester film with a thickness of 188 μm, serving as a support and dried, so that a reversible thermosensitive recording layer with a thickness of about 15 μm was formed on the polyester film.

[Formation of Protective Layer]

The same coating liquid for the formation of the protective layer as employed in Example 1 was coated on the above formed reversible thermosensitive recording layer, dried, and subjected to ultraviolet irradiation, so that a protective layer comprising an ultraviolet-curing resin with a thickness of about 4 μm was formed on the reversible thermosensitive recording layer.

Thus, a reversible thermosensitive recording material No. 2, which is hereinafter referred to as Thermosensitive Film 2, for use in the present invention was obtained, which is capable of assuming a transparent state when heated to a first specific temperature which ranges from about 70° C. to 100° C., and which is also capable of assuming a milky white state when heated to a second specific temperature which is about 100° C. or more as a second specific temperature.

Furthermore, the previously mentioned coating liquid for the formation of the reversible thermosensitive recording layer was coated on an about 400 Åthick aluminum layer deposited polyester film with a thickness of 188 μm, and dried, so that a reversible thermosensitive recording layer was formed on the aluminum layer deposited polyester film and was then peeled off the polyester film, whereby only a reversible thermosensitive recording layer for Thermosensitive Film 2 was obtained.

Example 3 [Preparation of Thermosensitive Film 3]

[Formation of Reversible Thermosensitive Recording Layer]

The following components were mixed to prepare a coating liquid for forming a reversible thermosensitive recording layer:

| | Parts by Weight |
|---|---|
| Behenic acid | 5 |
| Eicosanedioic acid | 5 |
| Vinyl chloride - vinyl acetate copolymer with a degree of polymerization of 3000 made by Kanagafuchi Chemical Industry Co., Ltd. | 39 |
| Tetrahydrofuran | 261 |
| Toluene | 87 |

The above prepared coating liquid was coated on a polyester film with a thickness of 188 μm, serving as a support and dried, so that a reversible thermosensitive recording layer with a thickness of about 15 μm was formed on the polyester film.

[Formation of Protective Layer]

The same coating liquid for the formation of the protective layer as employed in Example 1 was coated on the above formed reversible thermosensitive recording layer, dried, and subjected to ultraviolet irradiation, so that a protective layer comprising an ultraviolet-curing resin with a thickness of about 4 μm was formed on the reversible thermosensitive recording layer.

Thus, a reversible thermosensitive recording material No. 3, which is hereinafter referred to as Thermosensitive Film 3, for use in the present invention was obtained, which is capable of assuming a transparent state when heated to a first specific temperature which ranges from about 70° C. to 100° C., and which is also capable of assuming a milky white state when heated to a second specific temperature which is about 100° C. or more as a second specific temperature.

Furthermore, the previously mentioned coating liquid for the formation of the reversible thermosensitive recording layer was coated on an about 400Å thick aluminum layer deposited polyester film with a thickness of 188 μm, and dried, so that a reversible thermosensitive recording layer was formed on the aluminum layer deposited polyester film and was then peeled off the polyester film, whereby only a reversible thermosensitive recording layer for Thermosensitive Film 3 was obtained.

Penetration Test

Each of the recording layers for Thermosensitive Films 1, 2 and 3, respectively obtained in Examples 1, 2 and 3 was formed into a lump with the application of heat thereto up to 130° C. Each lamp was formed into the shape of a cylinder having a diameter of 10 mm and a length of 20 mm to prepare a test sample for the following penetration test:

The penetration test was conducted in an atmosphere of heated air by penetrating each test sample with a needle for 5 seconds, using a penetrometer in accordance with JIS-K2808 provided with a sinker with a weight of 50 g.

The results are shown in FIG. 3. The softening points of the recording layers of thermosensitive Films 1, 2 and 3 respectively obtained in Examples 1, 2 and 3 were respectively determined to be 362° K., 384° K., and 397° K. from the results shown in FIG. 3.

Measurement of the Temperature of The Surface of Thermal Head

The temperature of the surface of a thermal head for use in the present invention was measured by an infrared temperature measurement apparatus. The ambient temperature for the above measurement was 25° C., and the temperature of the surface of the thermal head was measured from the peak temperature thereof at a first pulse application with the energy applied thereto changed as shown in Table 1.

TABLE 1

| Energy (mJ/dot) | 0.34 | 0.41 | 0.48 |
|---|---|---|---|
| Temperature (°K.) | 418 | 447 | 475 |

Repetition of Image Recording

Thermosensitive Films 1, 2 and 3 prepared respectively in Examples 1, 2, and 3 were subjected to a repeated image recording test by use of the abovementioned thermal head, having a convex shape with a curvature of 1.5 mm, to investigate the changes in image density.

Milky white images were formed in each of Thermosensitive Films 1, 2 and 3 by the thermal head and the milky white images were erased by making the milky white image transparent with a hot stamp brought into contact with each Thermosensitlve Film which was stationarily placed. This image formation and image erasure cycle was repeated 200 times.

The above image formation was conducted, with the period of the applied pulse being fixed at 4 msec and the width of the pulse being fixed at 1 ms, and with the voltage applied to the thermal head, and the load applied to the platen being respectively changed, indicated by the stress σ changed as shown in Table 2, to investigate the changes in the image density. The results are shown in Table 2.

Figure 7:
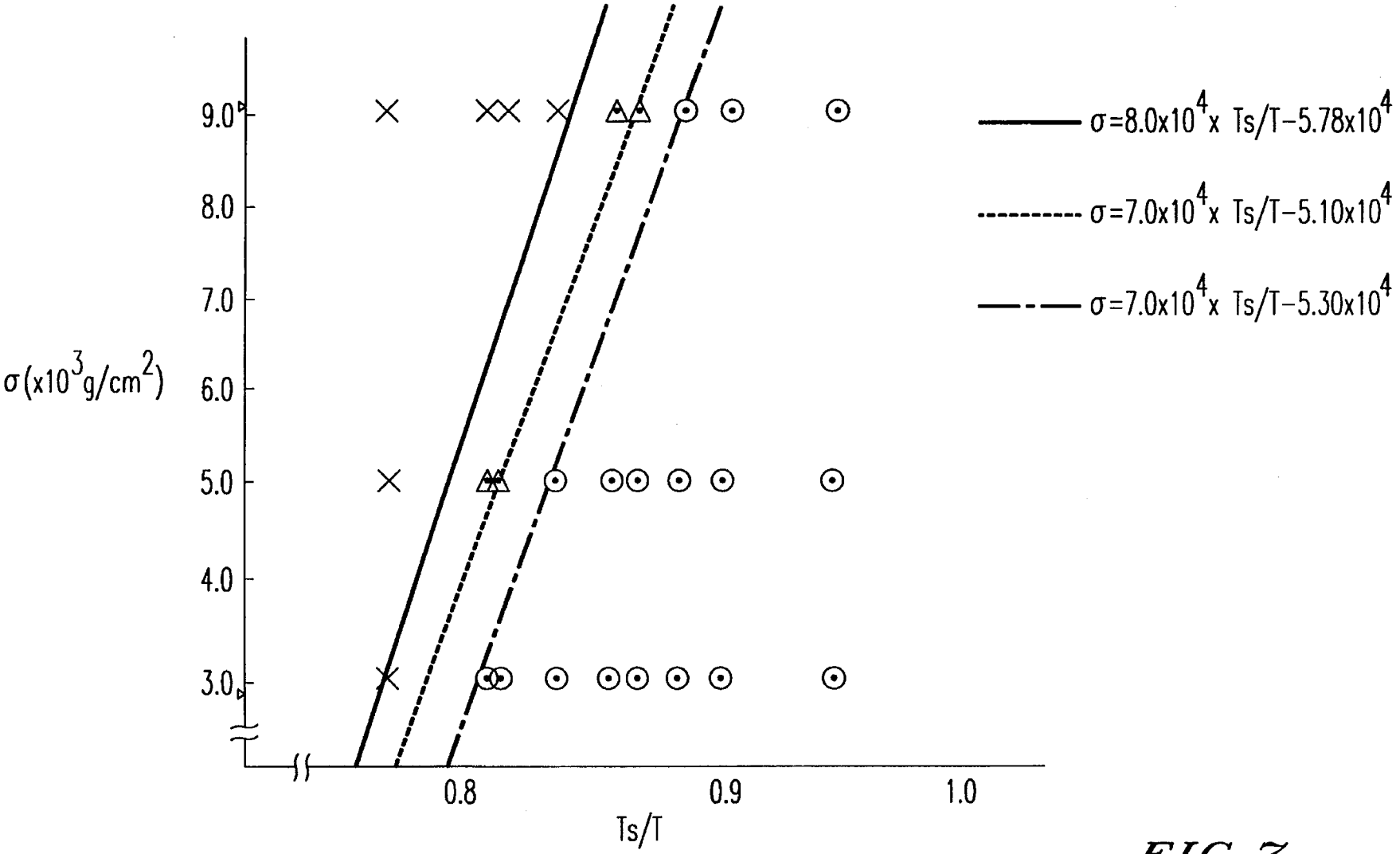
FIG. 7 is a graph showing the relationship between the stress $\sigma$ (g/cm$^2$) applied to a reversible thermosensitive recording material for use in the present invention and the ratio ($T_0$/T) of the softening point ($T_0$) of the reversible thermosensitive recording material to the temperature (T) of a heating element.

The relationship among the results shown in Table 1, the values of the softening point, and the results shown in Table 2 were plotted as in FIG. 7.

The border line in this diagram shown in FIG. 7 is represented by the following formula:

$$\sigma \leqq A(Ts/T)+B \qquad \text{(I)},$$

wherein A is $8.0\times10^4$, B is $-5.78\times10^4$, T (K°) represents the temperature of the surface of the heating element and Ts (K°) represents the softening point of the reversible thermosensitive recording material.

TABLE 2

| | | Thermosensitive Film 1 | | | Thermosensitive Film 2 | | | Thermosensitive Film 3 | | |
|---|---|---|---|---|---|---|---|---|---|---|
| Energy (mJ/Dot) | $\sigma \times 10^3$ (g/cm$^2$) | Initial | After 200 times | Evaluation | Initial | After 200 times | Evaluation | Initial | After 200 times | Evaluation |
| 0.34 | 2.95 | 0.61 | 0.62 | ◎ | 0.62 | 0.61 | ◎ | 0.63 | 0.62 | ◎ |
| | 5.15 | 0.60 | 0.68 | ◎ | 0.61 | 0.61 | ◎ | 0.62 | 0.62 | ◎ |
| | 9.16 | 0.59 | 0.89 | △ ◎ | 0.61 | 0.65 | ◎ | 0.62 | 0.63 | ◎ |
| 0.41 | 2.95 | 0.58 | 0.67 | ◎ | 0.60 | 0.63 | ◎ | 0.61 | 0.63 | ◎ |
| | 5.15 | 0.57 | 0.87 | △ | 0.59 | 0.69 | ◎ | 0.61 | 0.65 | ◎ |
| | 9.16 | 0.57 | 1.35 (100 times) | X | 0.59 | 0.93 | △ | 0.60 | 0.69 | ◎ |
| 0.48 | 2.95 | 0.55 | 1.25 (100 times) | X | 0.59 | 0.70 | ◎ | 0.60 | 0.69 | ◎ |
| | 5.15 | 0.55 | 1.22 (100 times) | X | 0.58 | 0.96 | △ | 0.61 | 0.74 | ◎ |
| | 9.16 | 0.56 | 1.28 (100 times) | X | 0.59 | 1.31 (100 times) | X | 0.60 | 1.01 | X |

In Table 2, "⊙" denotes a difference of less than 0.3 between the initial image density of the images formed on each Thermosensitive Film and the image density thereof after 200-time repetition of image formation; "▲" denotes a difference of 0.3 to 0.5; and "x" denotes a difference of more than 0.5.

According to the present invention, the deterioration of a reversible thermosensitive recording material, which is caused by the depletion of image formation by use of a thermal head, can be prevented.

What is claimed is:

1. A recording method for forming images on a reversible thermosensitive recording material, which comprises bringing a heating element of a thermal head into pressure contact with said reversible thermosensitive recording material, which is capable of assuming a first colored state when heated to a first temperature which is higher than room temperature, and then cooled, and which is capable of assuming a second colored state when heated to a second temperature which is higher than said first temperature, and then cooled, and relatively moving at least one of said heating element or said reversible thermosensitive recording material and controlling the pressure contact and the relative motion so that the stress exerted on said reversible thermosensitive recording material per unit area thereof, $\sigma$ ($g/cm^2$), which is generated by the pressure contact of said heating element with said reversible thermosensitive recording material and by the relative movements of said heating element and said reversible thermosensitive recording material, is represented by formula (I):

$$\sigma \leqq A(Ts/T)+B$$

wherein A is $8.0\times10^4$, B is $-5.78\times10^4$, T (K°) represents the temperature of the surface of the heating element and Ts (K°) represents the softening point of said reversible thermosensitive recording material.

2. The recording method as claimed in claim 1, wherein said reversible thermosensitive recording material comprises a matrix resin and an organic low-molecular-weight material dispersed in said matrix resin, capable of reversibly assuming a transparent state or a milky white opaque state with the application of heat to said reversible thermosensitive recording material.

3. The recording method as claimed in claim 2, wherein the relative movements of said reversible thermosensitive recording material and said heating element are composed of a repetition of minute periods of relative movements and terminations thereof, and wherein said reversible thermosensitive material is softened when in contact with said heating element by the application of heat application pulses to the thermal head, comprising adjusting the timing of the heating element and the relative movements so that the period in which said reversible thermosensitive recording material is softened in contact with said heating element and the period of said minute termination overlap, said overlap defined as, chronologically, applying pressure contact and heat by the heating element during a minute period of relative movement, continuing application of pressure and heat while initiating a period of minute termination at the time of commencement of the softening period of the thermosensitive material, and terminating the application of heat before a point in time which is the end of the softening period, which point in time is before initiation of the next period of relative movement.

4. The recording method as claimed in claim 2, wherein the pressure contact is controlled so that stress exerted by said heating element while said reversible thermosensitive recording material is softened in contact with said heating element of said thermal head is smaller than the stress exerted before and after the softening of said reversible thermosensitive recording material.

5. The recording method as claimed in claim 1, wherein the relative movements of said reversible thermosensitive recording material and said heating element are composed of a repetition of minute periods of relative movements and terminations thereof, and wherein said reversible thermosensitive material is softened when in contact with said heating element by the application of heat application pulses to the thermal head, comprising adjusting the timing of the heating element and the relative movements so that the period in which said reversible thermosensitive recording material is softened in contact with said heating element and the period of said minute termination overlap, said overlap defined as, chronologically, applying pressure contact and heat by the heating element during a minute period of relative movement, continuing application of pressure and heat while initiating a period of minute termination at the time of commencement of the softening period of the thermosensitive material, and terminating the application of heat before a point in time which is the end of the softening period, which point in time is before initiation of the next period of relative movement.

6. The recording method as claimed in claim 1, wherein the pressure contact is controlled so that stress exerted by said heating element while said reversible thermosensitive recording material is softened in contact with said heating element of said thermal head is smaller than the stress exerted before and after the softening of said reversible thermosensitive recording material.

* * * * *

UNITED STATES PATENT AND TRADEMARK OFFICE

CERTIFICATE OF CORRECTION

PATENT NO. : 5,612,278
DATED : MARCH 18, 1997
INVENTOR(S) : FUMIHITO MASUBUCHI ET AL.

It is certified that error appears in the above-identified patent and that said Letters Patent is hereby corrected as shown below:

Column 1, line 17, "to n reversible" should read --to a reversible--.

Column 5, line 29, "a reversibly" should read --a reversible--.

Column 5, line 49, "several hundreds" should read --several hundred--.

Column 5, line 59, "hundreds times" should read --hundred times--.

Column 5, line 64, "B=-5.78x$10^4$, (K°)" should read --B=-5.78x$10^4$, T (K°)--.

Column 6, line 14, "the stress c" should read --the stress σ--.

Column 7, line 17, "AS illustrated" should read --As illustrated--.

Column 9, line 7, "can be also be" should read --can also be--.

Column 9, line 57, "can effectively reduced" should read --can be effectively reduced--.

Column 12, line 1, "when" should read --When--.

UNITED STATES PATENT AND TRADEMARK OFFICE

CERTIFICATE OF CORRECTION

PATENT NO. : 5,612,278
DATED : MARCH 18, 1997
INVENTOR(S) : FUMIHITO MASUBUCHI ET AL.

It is certified that error appears in the above-identified patent and that said Letters Patent is hereby corrected as shown below:

Column 12, line 6, "the maxime milky" should read --the maximum milky--.

Signed and Sealed this

Twenty-ninth Day of September, 1998

*Attest:*

*Attesting Officer*

BRUCE LEHMAN

*Commissioner of Patents and Trademarks*